United States Patent [19]

Restle

[11] 4,161,831

[45] Jul. 24, 1979

[54] PICTURE MOUNTING AND DISPLAY

[76] Inventor: Donald J. Restle, 168 Melrose Ave., Youngstown, Ohio 44512

[21] Appl. No.: 837,162

[22] Filed: Sep. 28, 1977

[51] Int. Cl.[2] ..... G09F 1/12

[52] U.S. Cl. ..... 40/160; 428/13; D11/132

[58] Field of Search ..... D11/132, 136, 138; 40/124.1, 160, 158; 35/26, 41

[56] References Cited

U.S. PATENT DOCUMENTS

| | | | |
|---|---|---|---|
| 861,822 | 7/1907 | Feher | 40/160 X |
| 1,473,800 | 11/1923 | Webb | 40/124.1 |
| 1,718,333 | 6/1929 | Coria | 40/160 X |
| 2,387,475 | 10/1945 | Stokoe | 40/160 X |
| 3,321,860 | 5/1967 | Dichtl et al. | 40/160 |
| 3,879,874 | 4/1975 | Broussard | 40/158 R |
| 3,897,345 | 8/1975 | Scheyer | 40/160 |
| 4,014,121 | 3/1977 | Moser | 40/158 R |

*Primary Examiner*—Louis G. Mancene
*Assistant Examiner*—Wenceslao J. Contreras
*Attorney, Agent, or Firm*—Webster B. Harpman

[57] ABSTRACT

A picture mounting and display wherein a picture, particularly a photograph, is cut into partially separate sections such as arms and legs and chin allowing these sections to be raised or depressed in relation to each other and shaped to give a visual impression of a lifelike dimensional quality to the photograph.

1 Claim, 4 Drawing Figures

PICTURE MOUNTING AND DISPLAY

BACKGROUND OF THE INVENTION (1) Field of the Invention

This invention relates to lifelike dimension treatment of photographs.

(2) Description of the Prior Art

Prior structures of this type have utilized photographs for construction of three-dimenstional images. For example see U.S. Pat. Nos. 3,897,645, 3,879,874 and 2,577,320.

U.S. Pat. No. 3,897,645 discloses a composite pictorial representation having a three-dimensional effect comprised of separate multiple copies of the photo spaced one over the other to form a background, middleground and foreground.

In the present invention a single photograph is partially cut allowing shaping and forming of interconnecting parts that are to be emphasized so as to give a dimensional quality to the photograph.

U.S. Pat. No. 3,879,874 discloses a system wherein a single photograph is mounted on a flat board, the subject of the picture cut out and the edges beveled.

In the present invention a subject in a photograph is cut from the background then cuts are made along various contour lines of the subject to allow the shaping and highlighting of the different portions of the subject relative to each other that are to be emphasized.

U.S. Pat. No. 2,577,320 discloses a perfumed containing painting comprising a respresentation of an object that is formed by using separate sections of a photograph detached from one another and placed in a separate and distinct layers spaced by a glass or plastic plate forming a multiple compartmented picture.

In the present invention partial cuts are made in the subject of the photograph so that certain sections can be emphasized by spacing the sections in relation to each other and shaping the parts so emphasized as to give them curving and realistic shapes.

SUMMARY OF THE INVENTION

A picture mounting and display wherein a photograph of the subject having been cut from the background is then partially cut so that specific sections can be emphasized by shaping and curving to form a relief of the various parts in relation to each other and being coated with a thick transparent material covering the contoured form in a permanent and protective fashion.

DESCRIPTION OF THE PREFERRED EMBODIMENT

Figure 1:
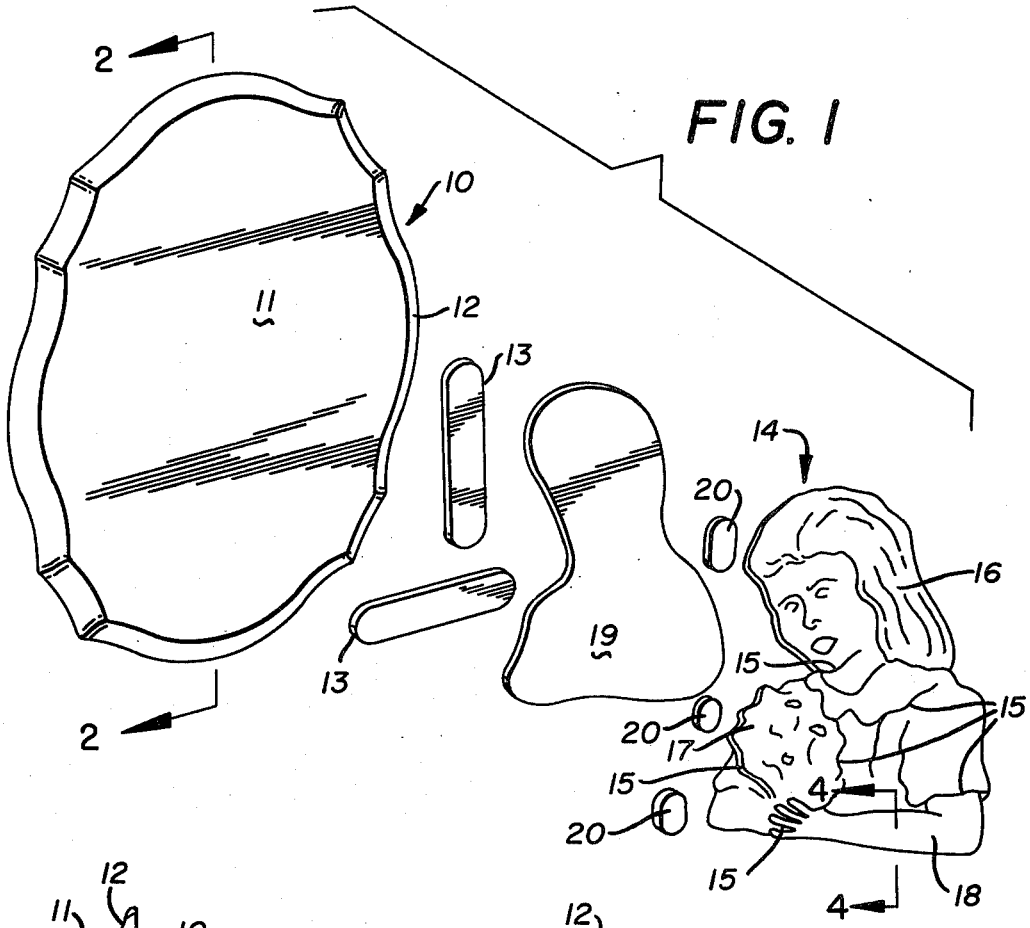
FIG. 1 is an exploded perspective view of the picture mounting and display.

In its simplest form the picture mounting and display as seen in FIG. 1 of the drawings, comprises a base 10 having a flat surface plane 11, the base 10 preferably has a beveled edge 12 formed around the perimeter thereof. Flat spacing members 13 are positioned on the flat surface plane 11 of the base 10. A photograph 14 of a person is cut away from its background and then partially cut along contour lines 15.

Figure 2:
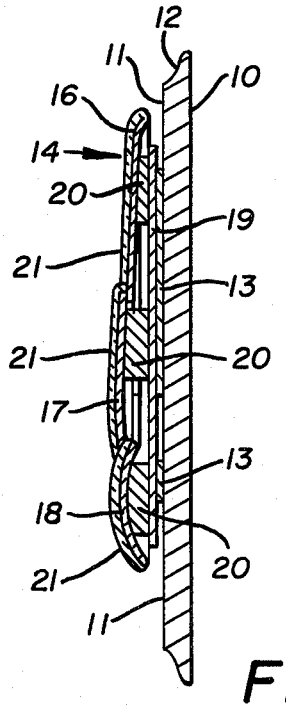
FIG. 2 is a vertical cross section on line 2—2 of FIG. 1.

As will be seen in FIG. 2 of the drawings, portions of the photograph 14 are then bowed side to side and top to bottom so as to form shaped interconnecting parts 16, 17 and 18, each of which are partially spaced with respect to one another and portions of each of which merge with one another. The shaped photograph 14 is then attached to a flat backing member 19 by a plurality of secondary spacing members 20 of varying thicknesses which position and secure the shaped photograph 14 to the flat backing member 19. The flat backing member 19 is then secured to the flat spacing members 13 which are in turn attached to the flat surface plane 11 of the base 10.

Figure 3:
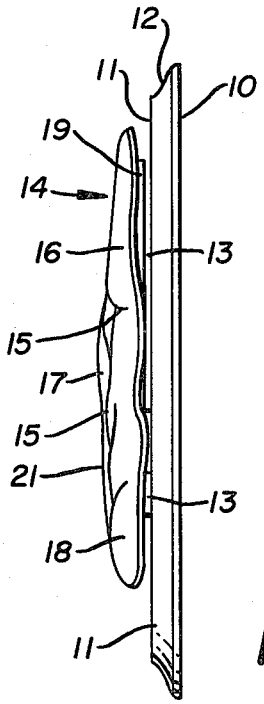
FIG. 3 is a side view of the picture mounting and display as assembled.
Figure 4:
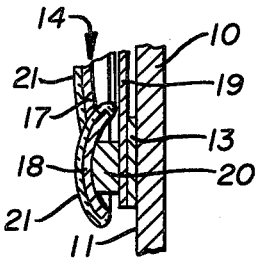
FIG. 4 is an enlarged cross section on line 4—4 of FIG. 1.

In FIG. 3 of the drawings, a photograph 14 having been so prepared, is then coated with a thick transparent material 21 available commercially under the name of Glass Kote, manufactured by Carolyn's Crafts of Bay Minette, Ala. The shaping heretofore described entails not only the partial separation of portions of the photgraph 14 into various parts but also the bending along the contour lines 15 and the perimeter of the photo 14 so as to form a curving and therefore a lifelike representation of the subject of the photo 14.

Although but one embodiment of the present invention has been illustrated and described, it will be apparent to those skilled in the art that various changes and modifications may be made therein without departing from the spirit of the invention and having thus described my invention what I claim is:

1. A picture mounting and display comprising a base, a photograph having portions thereof partially cut away from other portions thereof, parts of said partially cut away portions being bowed vertically and horizontally, some of said partially cut away portions being spaced outwardly and some of said partially cut away portions being spaced inwardly, both in a different degree with respect to parts of said other portions so as to form shaped interconnecting parts of said photograph, a flat backing member adjacent said photograph engaging parts of said other portions and at least one spacing member positioned between said backing member and said base.

* * * * *